US011480320B1

(12) United States Patent
Huang et al.

(10) Patent No.: US 11,480,320 B1
(45) Date of Patent: Oct. 25, 2022

(54) REVERSIBLE LED LAMP

(71) Applicant: Guangzhou LEDIA Lighting Co., Ltd., Guangzhou (CN)

(72) Inventors: Canming Huang, Guangzhou (CN); Congwen Zhu, Guangzhou (CN); Jing Lan, Guangzhou (CN); Yongguo Huang, Guangzhou (CN); Yuanneng Song, Guangzhou (CN); Yusheng Liu, Guangzhou (CN)

(73) Assignee: GUANGZHOU LEDIA LIGHTING CO., LTD., Guangdong (CN)

( * ) Notice: Subject to any disclaimer, the term of this patent is extended or adjusted under 35 U.S.C. 154(b) by 0 days.

(21) Appl. No.: 17/742,684

(22) Filed: May 12, 2022

(30) Foreign Application Priority Data

Dec. 24, 2021 (CN) ..... 2021116024059

(51) Int. Cl.

| | |
|---|---|
| ***F21V 17/10*** | (2006.01) |
| ***F21S 4/28*** | (2016.01) |
| ***F21V 17/16*** | (2006.01) |
| ***F21V 23/06*** | (2006.01) |
| ***F21V 7/00*** | (2006.01) |
| ***F21V 7/05*** | (2006.01) |

(Continued)

(52) U.S. Cl.
CPC ..... *F21V 17/107* (2013.01); *F21S 4/28* (2016.01); *F21V 7/0025* (2013.01); *F21V 7/05* (2013.01); *F21V 17/164* (2013.01); *F21V 23/06* (2013.01); *F21Y 2103/10* (2016.08); *F21Y 2115/10* (2016.08)

(58) Field of Classification Search
CPC ..... F21V 17/107; F21V 7/0025; F21V 7/05; F21V 17/164; F21V 23/06; F21S 4/28; F21Y 2103/10; F21Y 2115/10
See application file for complete search history.

(56) References Cited

U.S. PATENT DOCUMENTS 6,461,026 B1 * 10/2002 Wang ..... F21V 17/107 362/374
2011/0019423 A1 * 1/2011 Ko ..... F21V 1/08 362/287
2022/0042661 A1 * 2/2022 Cattivelli ..... F21L 4/085

FOREIGN PATENT DOCUMENTS

CN 204328900 U 5/2015
CN 113653968 * 11/2021

OTHER PUBLICATIONS

English Translation of CN113653968 Pan, published Nov. 16, 2021 (Year: 2021).*

* cited by examiner

*Primary Examiner* — Evan P Dzierzynski
(74) *Attorney, Agent, or Firm* — Dinsmore & Shohl LLP

(57) ABSTRACT

A reversible LED lamp has a fixed support including first and second plate bodies. One side of the first body is connected to the second; the other is connected to a first limiting member. A rotating support includes a third plate body and rotating support member. One side of the third body is connected to a first rotating portion; the other side is connected to the rotating support member, below the second and third bodies. A side of the rotating support member close to the second body is flush therewith. The plate bodies and rotating support member form a power supply installation space. A light-emitting assembly is in a light source installation space in the rotating support member. When a power supply in the power supply installation space is repaired/replaced, the rotating support is unfolded. The rotating support is rotatable in the fixed support, which has an avoidance groove.

10 Claims, 15 Drawing Sheets

(51) Int. Cl.
*F21Y 115/10* (2016.01)
*F21Y 103/10* (2016.01)

REVERSIBLE LED LAMP

CROSS-REFERENCE TO RELATED APPLICATION

This application claims priority to China application number 2021116024059 filed Dec. 24, 2021, the disclosure of which is hereby incorporated by reference in its entirety.

FIELD OF THE INVENTION

The present invention relates to the field of lighting technologies, and in particular, to a reversible LED lamp.

BACKGROUND OF THE INVENTION

Linear lamps are used for local illumination. Existing linear lamps are each integrated, and the linear lamps each have a fixed size and a length that cannot be lengthened or shortened according to lighting requirements, and are inconvenient to use. A support of an existing lamp body is fixed to a cover plate by a screw. During replacement or repair, the screw needs to be removed before the inside of the lamp body can be open. This is inconvenient to operate. In addition, when the existing lamp body is installed, the support needs to be installed on an installation surface first, and then the support is installed well and then the cover plate is installed with the support. Therefore, if a module in the support needs to be replaced, the lamp body needs to be disassembled first, and then the cover plate is disassembled for replacement, and thus the operation is complicated.

The Chinese patent No. 201520023895.0 published on May 13, 2015 discloses a side beam assembly for an LED lighting device and an LED lighting device, including a side beam, a side beam cover plate, and a support, where the side beam cover plate is rotatably connected to the side beam, the support is rotatably connected to the side beam and the side beam cover plate, and the side beam cover plate can be buckled on the side beam or an end of the side beam cover plate can be away from the side beam by rotating the side beam cover plate; and a module can be installed or replaced by overturning the side beam cover plate.

A connecting shaft of the side beam assembly is longitudinally limited in a limiting groove. A limiting structure with a width smaller than that of the connecting shaft is arranged at an upper end of the limiting groove. Because a size of the limiting structure is smaller than that of the connecting shaft, the connecting shaft cannot be separated from the limiting groove in a longitudinal direction, thereby implementing longitudinal limiting to the connecting shaft. To implement rotation of the connecting shaft, a plate body is arranged between the side beam cover plate and the connecting shaft. When the connecting shaft is arranged in the limiting groove, the plate body is arranged in the limiting structure. When the side beam cover plate is opened or closed, the side beam cover plate swings with the support. However, no avoidance structure for the plate body to move is provided in the limiting structure. Rotation of the lower end of the side beam cover plate needs to be supported by the support, so that a swing amplitude of the plate body is small. An unfolding amplitude of the side beam cover plate is small. In this way, a construction area formed by the side beam cover plate and the support is small, and construction is not facilitated during assembly replacement and repair. In addition, the side beam cover plate only repairs an LED module placed in the side beam cover plate. If a light-emitting component and a power supply component in the LED module are arranged in different areas, a plurality of side beam cover plates need to be additionally added to implement repair in different areas, and the structure is complicated.

SUMMARY OF THE INVENTION

The present invention provides a reversible LED lamp, where a fixed support is provided with an avoidance structure, a rotation amplitude of a rotating support relative to the fixed support is large, an unfolding amplitude of the rotating support is large, and the fixed support and the rotating support form a power supply installation space; unfolding the rotating support opens the power supply installation space; and the reversible LED lamp is simple in structure and convenient to repair.

To achieve the foregoing objective, the technical solution of the present invention is as follows: A reversible LED lamp includes a lamp body, where the lamp body includes a fixed support and a rotating support, where the fixed support is connected to a fixing member, the rotating support is connected to a rotating member, and the rotating member is rotatably arranged on the fixing member; the fixed support is arranged on one side of the lamp body, and the rotating support is arranged on the other side of the lamp body; the fixing member includes a first limiting member and a second limiting member, and the second limiting member is located on a side of the first limiting member; the first limiting member is recessed in a direction away from the second limiting member to form an avoidance groove, and the avoidance groove is configured to accommodate the rotating member.

The fixed support includes a first plate body and a second plate body; one side of the first plate body is connected to the second plate body, and the other side of the first plate body is connected to the first limiting member; the rotating support includes a third plate body and a rotating support member; one side of the third plate body is connected to a first rotating portion, and the other side of the third plate body is connected to the rotating support member; the rotating support member is positioned below the second plate body and the third plate body; a side of the rotating support member close to the second plate body is flush with the second plate body; the first plate body, the second plate body, the third plate body and the rotating support member form a power supply installation space; a light source installation space is formed in the rotating support member, and a light-emitting assembly is arranged in the light source installation space.

According to the foregoing arrangements, the avoidance groove is provided, so that an accommodating space between the first limiting portion and the second limiting portion is increased; and a moving amplitude of the rotating member in the fixing member is large. The rotating member is not subjected to interference when rotating on the fixing member. In addition, the avoidance groove is configured to accommodate the rotating member. When the rotating member rotates in the fixing member, the rotating member gradually approaches the avoidance groove until the rotating member is accommodated in the avoidance groove, so that rotation of the rotating member is not subjected to interference. In addition, because the avoidance groove is formed by recessing the first limiting portion, when a side of the rotating member is accommodated in the avoidance groove, the first limiting portion vertically limits the rotating member; and the second limiting portion horizontally limits the rotating member, so that the rotating member cannot be separated from the fixing member.

In addition, the second plate body is flush with a side of the rotating support member, to facilitate installation. The power supply installation space is formed between the fixed support and the rotating support, and is configured to install a power supply. Therefore, when the power supply in the power supply installation space needs to be repaired or replaced, only the rotating support needs to be unfolded, and the power supply installation space is opened for operation. In addition, a light source installation space is formed in the rotating support. When the light-emitting assembly needs to be repaired or replaced, only the rotating support needs to be opened for operation. The structure is simple and the operation is convenient.

Further, the second plate body extends toward the rotating support to form an elastic clamping member; the rotating support member extends toward the second plate body to form a clamping portion and a lap joint portion; the clamping portion is clamped on the elastic clamping member; the lap joint portion abuts against the second plate body; and a contact structure is arranged at a bottom end of the rotating support member away from the rotating member.

According to the foregoing arrangements, when the rotating support is folded, the elastic clamping member clamps the clamping portion; the rotating support is stably connected to the fixed support; and in a natural state, the elastic clamping member limits the clamping portion, so that the rotating support and the fixed support are not separated from each other. In addition, the elastic clamping member has elasticity. When the rotating support is driven to be unfolded, it is convenient to separate the clamping portion from the elastic clamping member. In addition, the lap joint portion abuts against the second plate body to implement connection between the rotating support member and the second plate body.

In addition, the contact structure is arranged to provide a point of strength. Action with the contact structure facilitates unfolding or folding the rotating support. In addition, the contact structure is arranged away from the rotating member, and an arm of force between the contact structure and the rotating member is long, so that the rotating support can be unfolded or folded easily.

Further, the first limiting portion includes a first limiting structure, a second limiting structure, and a fourth limiting structure; the second limiting portion includes a third limiting structure and a fifth limiting structure; the first limiting structure is connected to one side of the second limiting structure, and the other side of the second limiting structure is connected to one end of the third limiting structure.

The avoidance groove is formed in the first limiting structure by recessing in a direction away from the second limiting portion; the avoidance groove is configured to accommodate the rotating member; the second limiting structure is recessed to form a rotating groove, and the rotating groove is formed by recessing in a direction perpendicular to a recessed part of the avoidance groove.

The fourth limiting structure is formed by extending from the top of the first limiting structure in a direction close to the rotating groove, and the avoidance groove is connected to the second limiting structure and the fourth limiting structure; the fifth limiting structure is formed by extending from the other end of the third limiting structure in a direction close to the fourth limiting structure; the rotating groove is connected to the fourth limiting structure and the fifth limiting structure; an accommodating groove is formed by the avoidance groove and the rotating groove.

According to the foregoing arrangements, a direction in which the rotating groove is recessed is perpendicular to a direction in which the avoidance groove is recessed. The rotating groove and the avoidance groove are each arranged on a side of the fixing member. A space of the accommodating groove is large, and the rotating groove and the avoidance groove do not interfere with each other. A moving range of the rotating member in the accommodating groove is large. The fourth limiting structure extends toward the rotating groove. When the rotating member is accommodated in the avoidance groove, the third limiting structure and the fourth limiting structure vertically limit the rotating member after rotation; and the first limiting structure and the fifth limiting structure horizontally limit the rotating member.

In addition, the avoidance groove, the rotating groove, the second limiting portion and the rotating member are arranged in an arc shape.

Further, the rotating member includes a first rotating portion arranged in an arc shape; a second rotating portion extends from one end of the first rotating portion to the other end of the first rotating portion; the first rotating portion and the second rotating portion form an arc-shaped movable groove; the first rotating portion and the second rotating portion cover the third limiting structure and the fifth limiting structure; a side of the second rotating portion close to the movable groove is provided with a rotating shaft; the rotating shaft extends into the rotating groove; the rotating shaft is movably arranged in the rotating groove; the second limiting structure is configured to limit a rotation angle of the rotating member; the third limiting structure and the fifth limiting structure are configured to vertically limit the first rotating portion before rotation, and the fifth limiting structure is configured to horizontally limit the second rotating portion before rotation; the third limiting structure and the fourth limiting structure are configured to vertically limit the first rotating portion after rotation, and the fifth limiting structure is configured to horizontally limit the second rotating portion after rotation.

According to the foregoing arrangements, the rotating member is movably arranged in the rotating groove through the rotating shaft, and when the rotating member rotates, the movable groove rotates relative to the second limiting portion. In this way, a matching effect between the fixing member and the rotating member is good.

Further, a left end and a right end of the fixed support are each provided with a first cover plate; the first cover plate extends toward the fixed support to form a first insertion portion; the first insertion portion is arranged on one side of the first cover plate, and the first insertion portion extends into the power supply installation space; and the first insertion portion is configured to fix the first cover plate.

According to the foregoing arrangements, the first insertion portion extends into the fixed support to fix the first cover plate. In this way, on the one hand, connection between the first cover plate and the fixed support is stable, which can increase a supporting strength of the lamp body support; and on the other hand, the first insertion portion extends into the fixed support to provide pre-positioning for installation of the first cover plate.

Further, the first cover plate extends toward the fixed support to form a first limiting member and a second limiting member; the first limiting member is arranged on the other side of the first cover plate; the second limiting member is located between the first insertion portion and the first limiting member and arranged at an end of the first cover plate; the first limiting member and the second limiting member extend into the power supply installation space; the first limiting member interacts with the third plate body; the second limiting member interacts with a fourth plate body; and the first limiting member and the second limiting member limit the rotating support.

According to the foregoing arrangements, the first limiting member and the second limiting member limit the rotating support; and when the rotating support is closed, the rotating support is prevented from continuing to approach the fixed support.

Further, the light source installation space includes a first accommodating area, a second accommodating area, a third accommodating area, and a fourth accommodating area; the first accommodating area is located on one side of the rotating support member, and the fourth accommodating area is located on the other side of the rotating support member; the second accommodating area and the third accommodating area are located between the first accommodating area and the fourth accommodating area; the first accommodating area is located between the second accommodating area and the third accommodating area; in a direction from the first accommodating area to the fourth accommodating area, the second accommodating area and the third accommodating area are separately inclined outward; the light-emitting assembly includes an LED light source, a first light guide plate, a second light guide plate, and a diffusion plate; the LED light source is arranged in the first accommodating area; the first light guide plate is arranged in the second accommodating area; the second light guide plate is arranged in the third accommodating area; and the diffusion plate is arranged in the fourth accommodating area.

According to the foregoing arrangements, through the arrangement of the second accommodating area and the third accommodating area which are inclined, the first light guide plate in the second accommodating area and the second light guide plate in the third accommodating area are also inclined. In addition, the second accommodating area and the third accommodating area are inclined outward, and light emitted by the LED light source is dispersed through the first light guide plate and the second light guide plate, and then emitted from the diffusion plate, thereby enhancing illumination brightness of the lamp body.

Further, a left end and a right end of the rotating support are each provided with a second cover plate; the second cover plate extends toward the rotating support to form a second insertion portion and a fourth insertion portion; the second insertion portion is arranged at one end of the second cover plate, and the fourth insertion portion is arranged at the other end of the second cover plate; the second insertion portion and the fourth insertion portion extend into the light source installation space; and the second insertion portion and the fourth insertion portion are configured to fix the second cover plate.

According to the foregoing arrangements, the second insertion portion and the fourth insertion portion extend into the rotating support to fix the second cover plate. In this way, connection between the second cover plate and the rotating support is stable, which can increase the supporting strength of the lamp body support.

Further, the second cover plate extends toward the rotating support to form a third insertion portion; the third insertion portion is located between the second insertion portion and the fourth insertion portion; a first insertion groove is formed between the second insertion portion and the third insertion portion; the first insertion groove communicates with the second accommodating area; a second insertion groove is formed between the fourth insertion portion and the third insertion portion; and the second insertion groove communicates with the third accommodating area. This further improves stability of the first light guide plate and the second light guide plate.

Further, adjacent lamp bodies are detachably connected to each other by connectors; one end of each lamp body is provided with a first interface; the other end of the lamp body is provided with a second interface; first interfaces and second interfaces of the adjacent lamp bodies are detachably connected to each other by connectors; one end of each of the connectors is provided with a first connecting portion matching the first interface; and the other end of the connector is provided with a second connecting portion matching the second interface.

According to the foregoing arrangements, two or more lamp bodies are connected by connectors for use. When a lighting area needs to be enlarged, one lamp body only needs to be electrically connected to another lamp body by a connector, and thus a plurality of lamp bodies can be installed for use. The number of lamp bodies can be set according to a use scenario. The arrangements are suitable for a wide range of use scenarios.

DETAILED DESCRIPTION OF THE INVENTION

The present invention will be further described in detail below with reference to the accompanying drawings and specific implementations.

Figure 1:
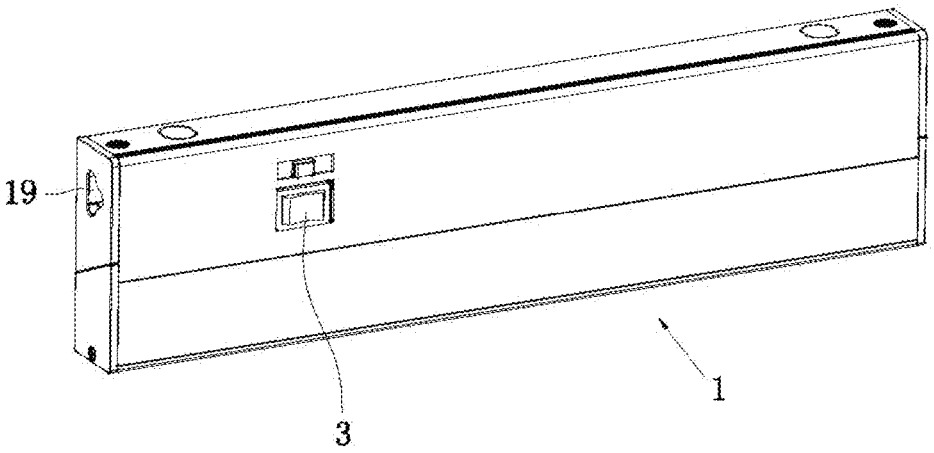
FIG. 1 is a schematic three-dimensional diagram of a lamp body in the present invention.
Figure 2:
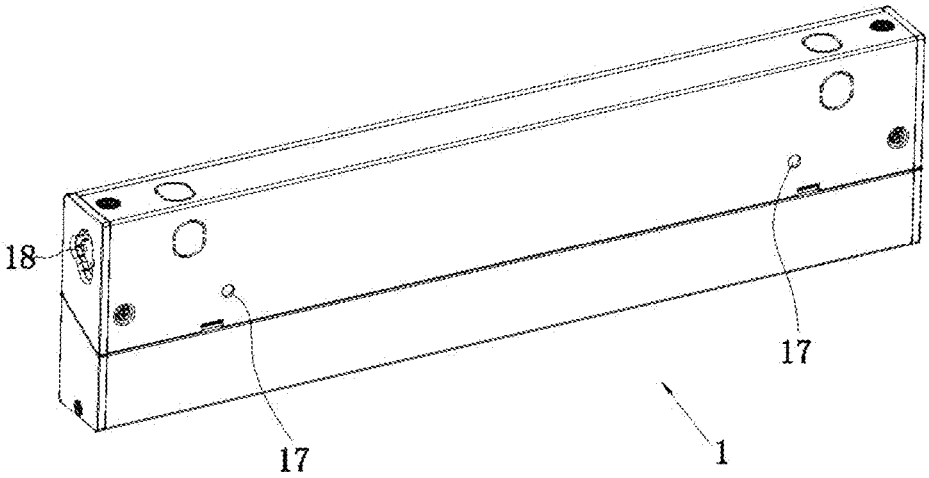
FIG. 2 is a schematic three-dimensional diagram of a lamp body in the present invention from another perspective.
Figure 3:
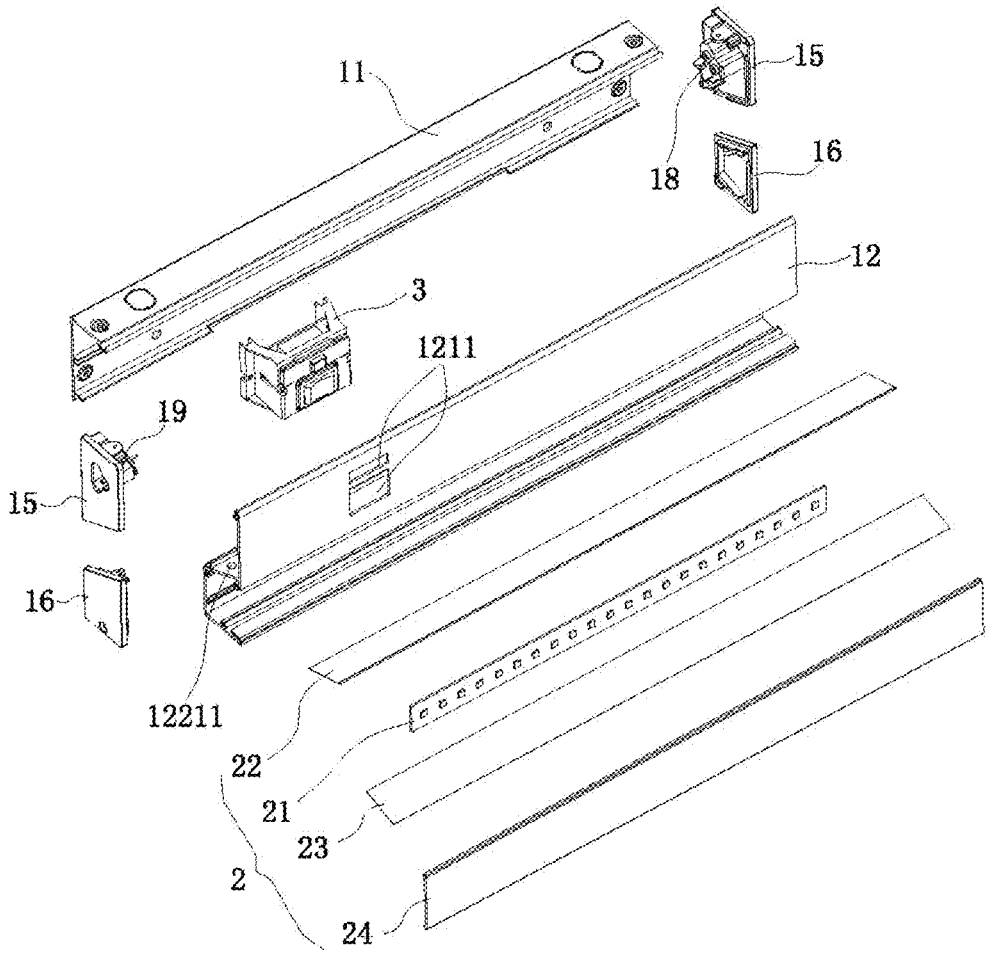
FIG. 3 is an exploded view of a lamp body in the present invention.
Figure 4:
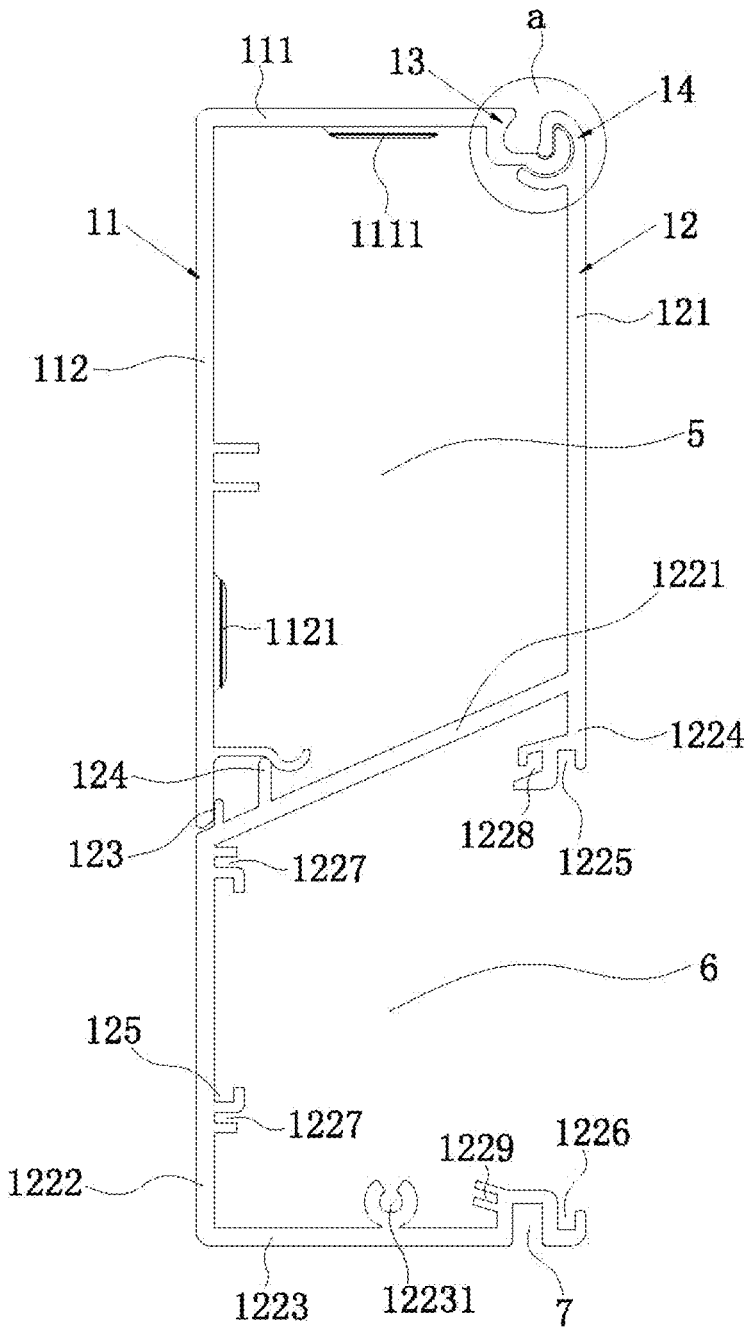
FIG. 4 is a schematic diagram of connection between a fixed support and a rotating support in the present invention.
Figure 5:
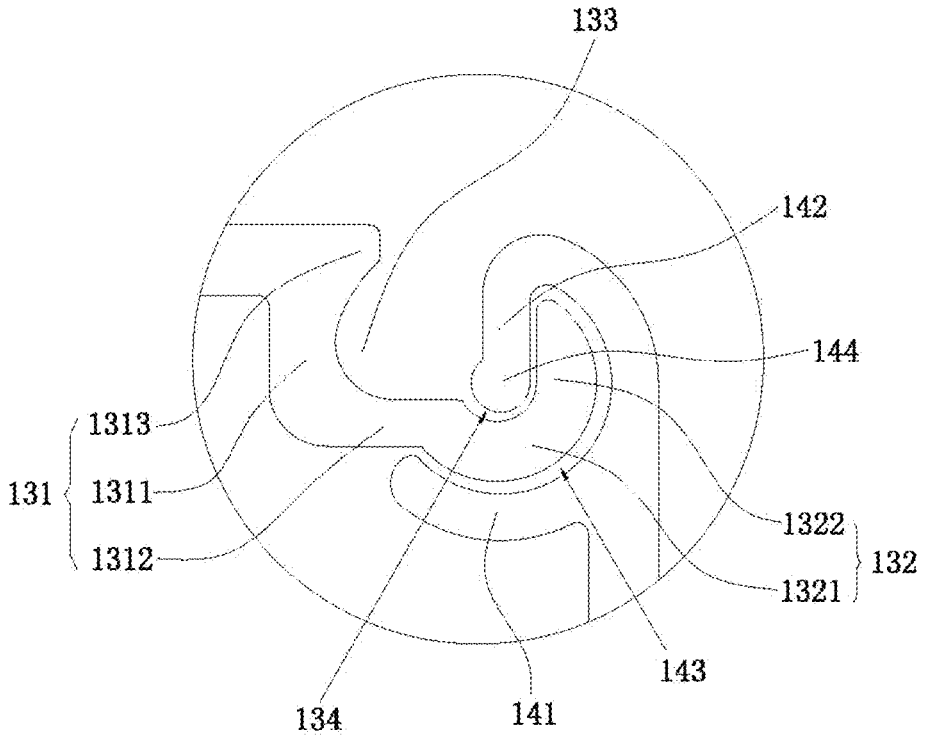
FIG. 5 is an enlarged view of a in FIG. 4.
Figure 6:
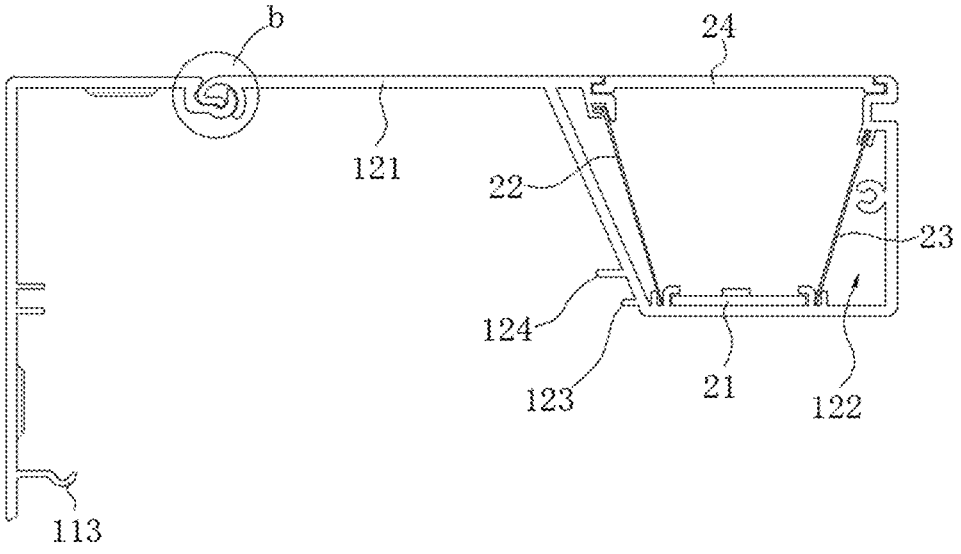
FIG. 6 is a schematic diagram of a rotating support in the present invention after being rotated and unfolded.
Figure 7:
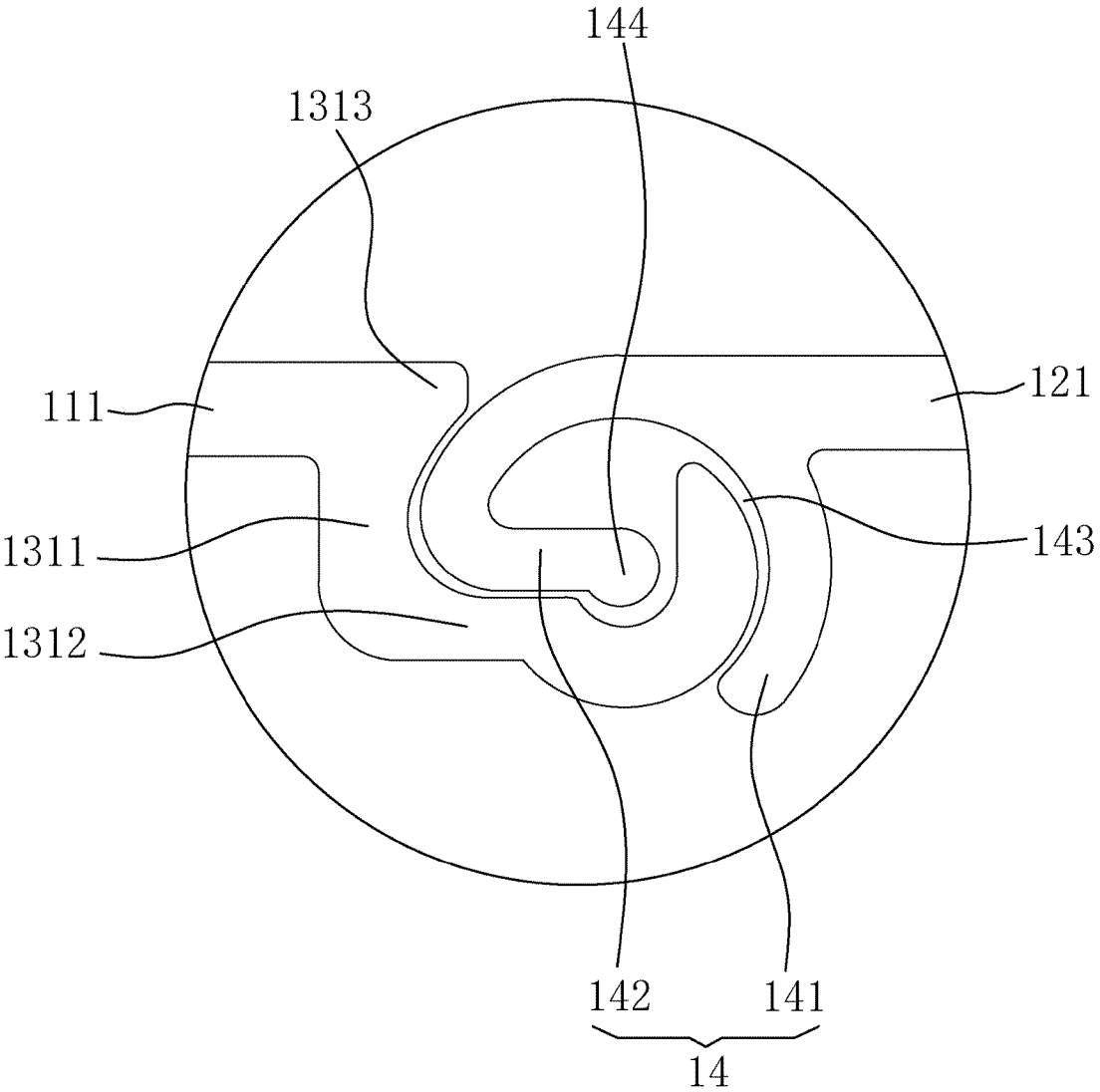
FIG. 7 is an enlarged view of b in FIG. 6.
Figure 8:
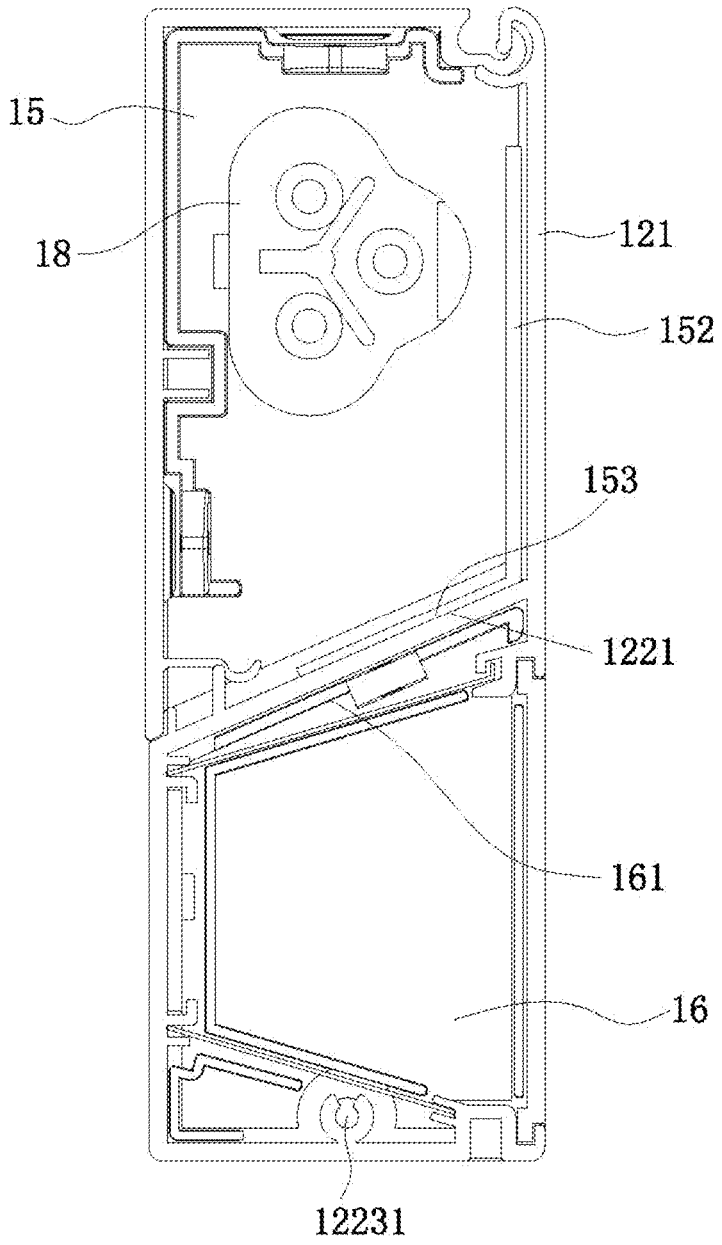
FIG. 8 is a schematic diagram of a first cover plate and a second cover plate with an end of a lamp body removed in the present invention.
Figure 9:
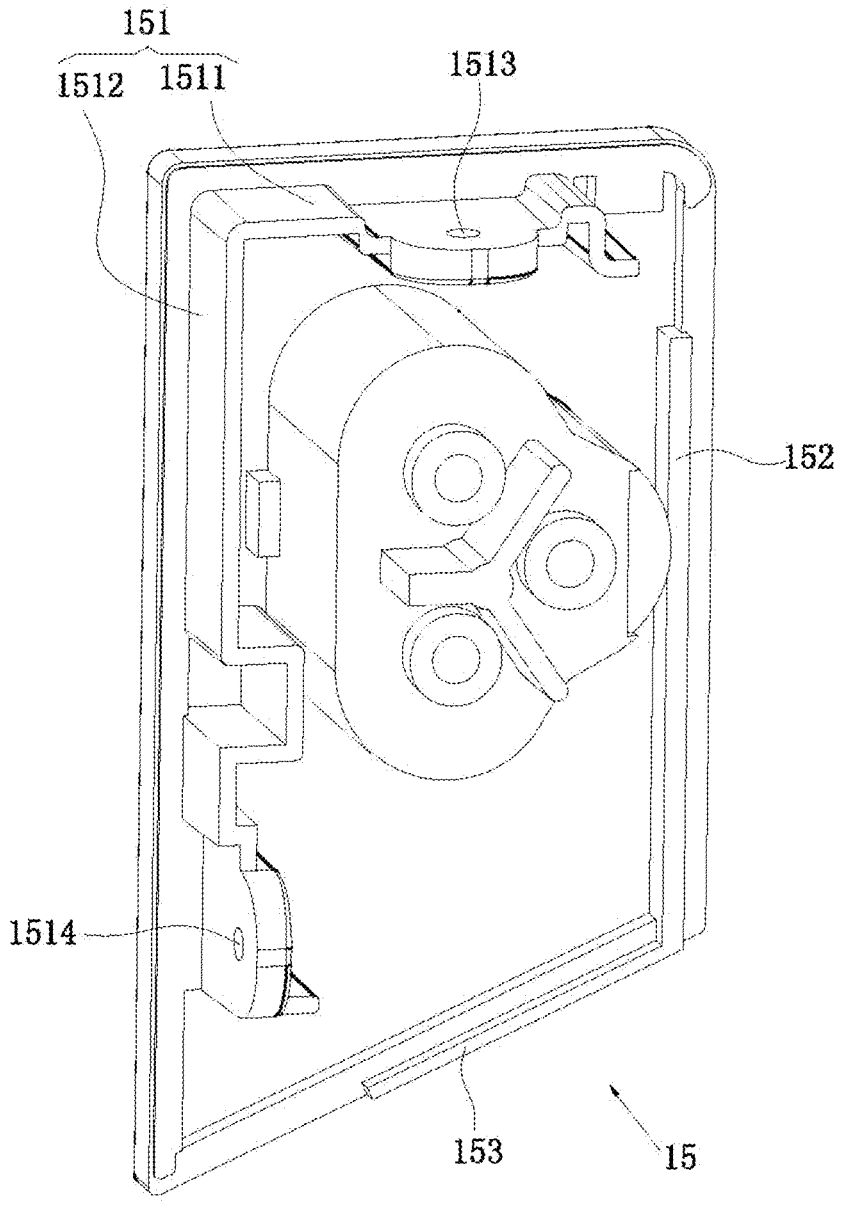
FIG. 9 is a schematic three-dimensional diagram of a first cover plate of a lamp body in the present invention.
Figure 10:
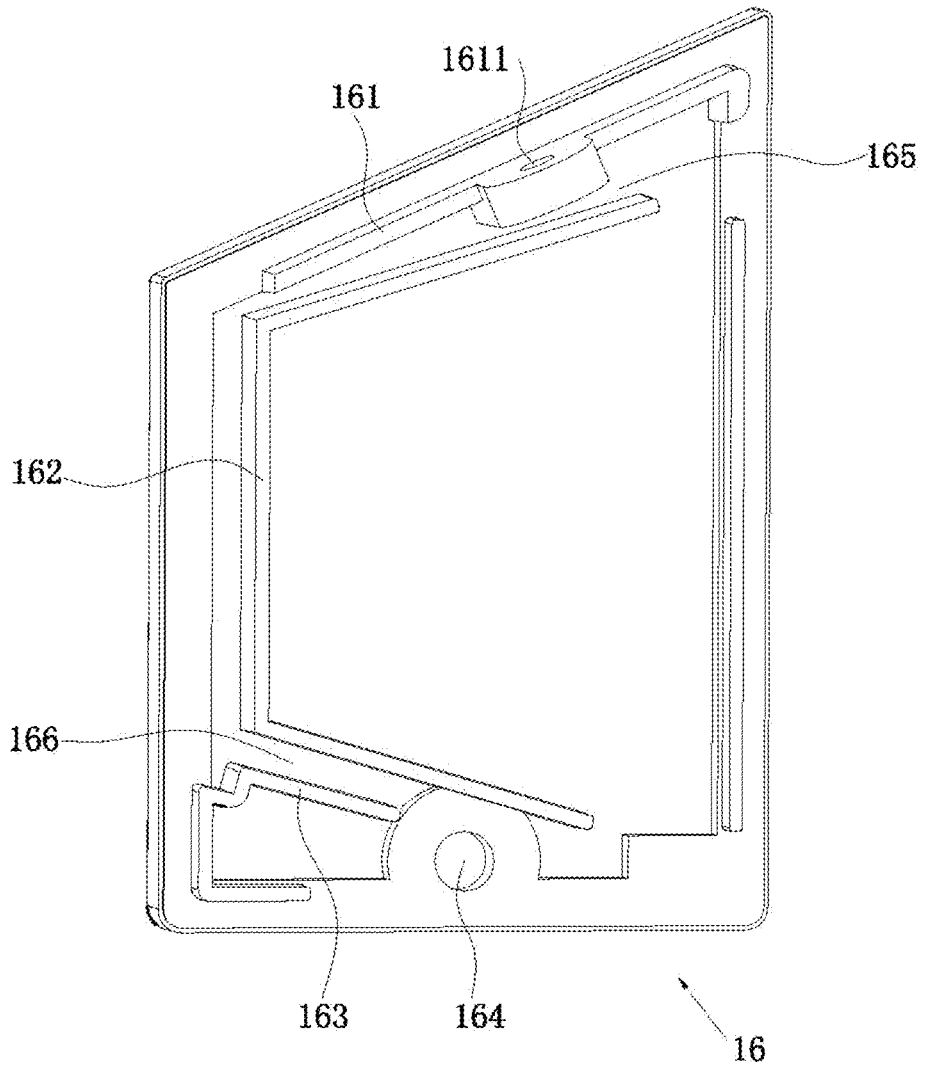
FIG. 10 is a schematic three-dimensional diagram of a second cover plate of a lamp body in the present invention.
Figure 11:
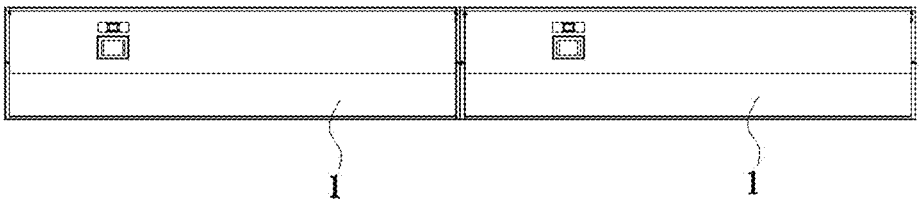
FIG. 11 is a schematic diagram of connection between two lamp bodies by a rigid connector.
Figure 12:
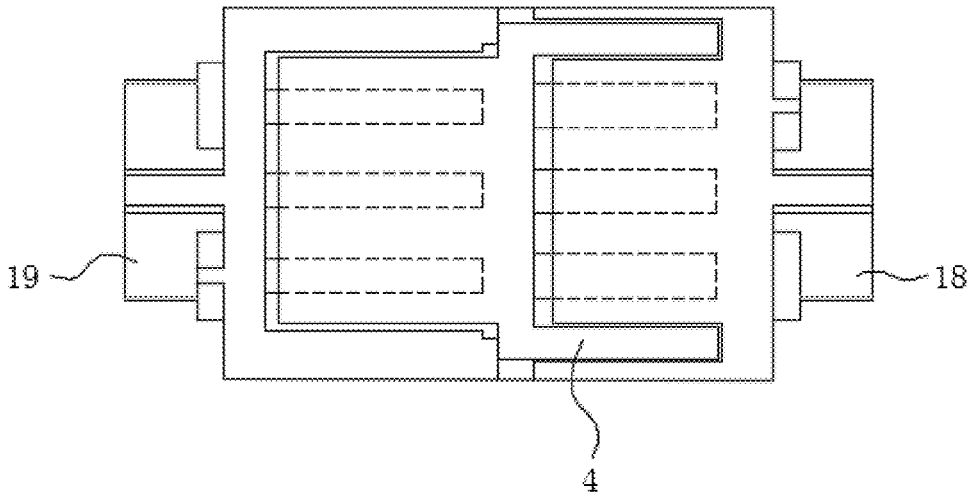
FIG. 12 is a schematic diagram of connection of a first interface and a second interface to a connector in the present invention
Figure 13:
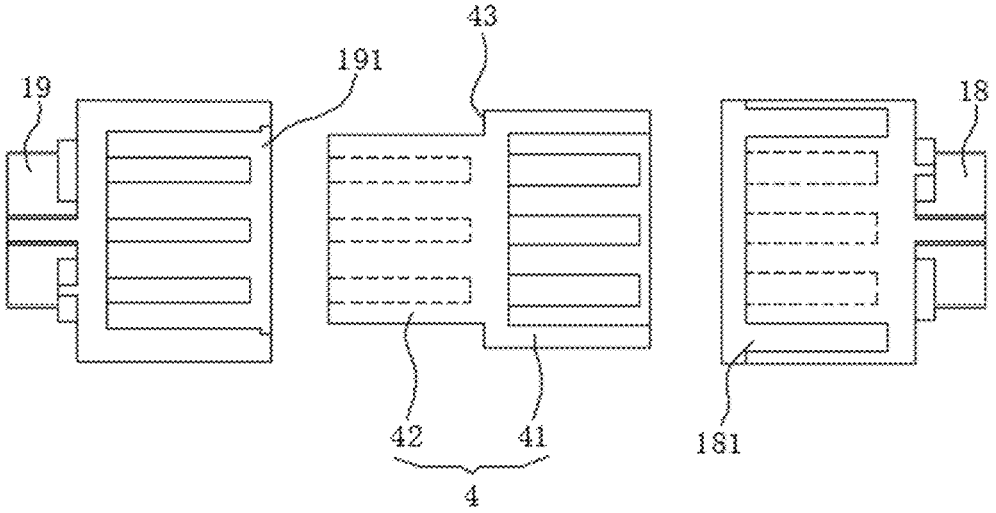
FIG. 13 is an exploded view of connection of a first interface and a second interface to a connector in the present invention.
Figure 14:
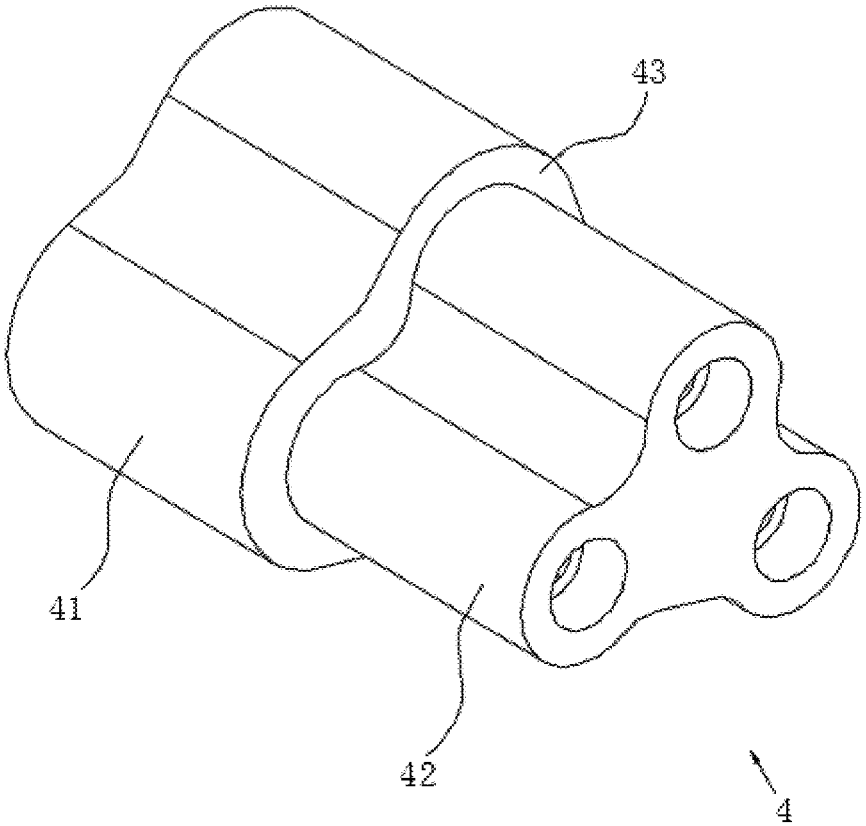
FIG. 14 is a schematic three-dimensional diagram of a rigid connector.
Figure 15:
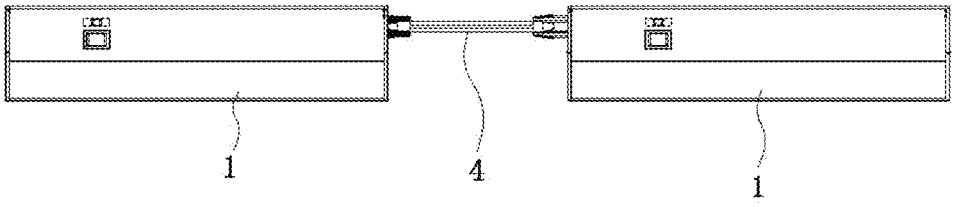
FIG. 15 is a schematic diagram of connection between two lamp bodies by a flexible connector.
Figure 16:
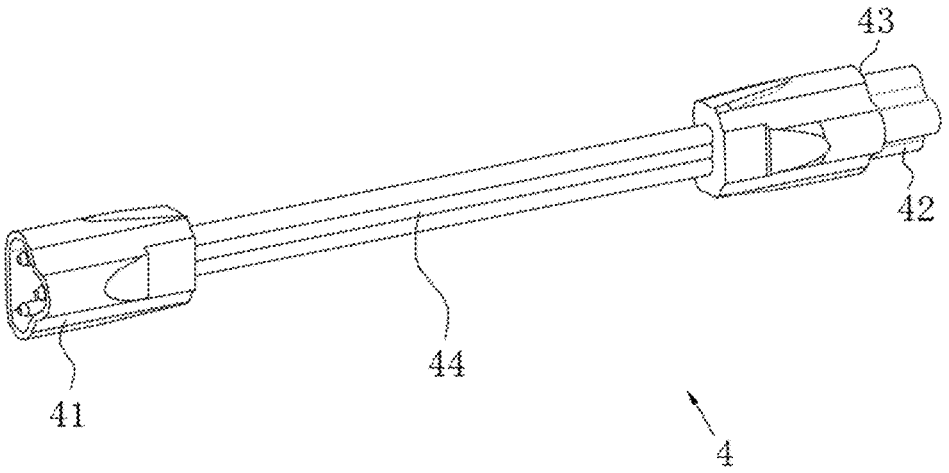
FIG. 16 is a schematic three-dimensional diagram of a flexible connector.

As shown in FIG. 1 to FIG. 16, a reversible LED lamp includes a lamp body 1, where the lamp body 1 includes a fixed support 11 and a rotating support 12, where the fixed support 11 is located on one side of the lamp body 1, and the rotating support 12 is located on the other side of the lamp body 1; the fixed support 11 is connected to a fixing member 13, the rotating support 12 is connected to a rotating member 14, and the rotating member 14 is rotatably arranged on the fixing member 13.

The fixing member 13 includes a first limiting portion 131 and a second limiting portion 132, the first limiting portion 131 is located on one side of the fixing member 13, and the second limiting portion 132 is located on the other side of the fixing member 13. The first limiting portion 131 includes a first limiting structure 1311, a second limiting structure 1312, and a fourth limiting structure 1313. The second limiting portion 132 includes a third limiting structure 1321 and a fifth limiting structure 1322. The first limiting structure 1311 is connected to a side of the second limiting structure 1312, and the other side of the second limiting structure 1312 is connected to an end of the third limiting structure 1321; and the first limiting structure 1311 is recessed in a direction away from the second limiting portion 132 to form an avoidance groove 133; and the avoidance groove 133 is configured to accommodate the rotating member 14. The second limiting structure 1312 is recessed to form a rotating groove 134, and the rotating groove 134 is formed by recessing in a direction perpendicular to a recessed part of the avoidance groove 133. The fourth limiting structure 1313 is formed by extending from the top of the first limiting structure 1311 in a direction close to the rotating groove 134, and the avoidance groove 133 is connected to the second limiting structure 1312 and the fourth limiting structure 1313; the fifth limiting structure 1322 is formed by extending from the other end of the third limiting structure 1321 in a direction close to the fourth limiting structure 1313; and the rotating groove 134 is connected to the fourth limiting structure 1313 and the fifth limiting structure 1322. An accommodating groove is formed by the avoidance groove 133 and the rotating groove 134. The avoidance groove 133 is provided to avoid the rotating member 14; when the rotating member 14 rotates in the accommodating groove, the rotating member 14 gradually approaches the avoidance groove 133 until the rotating member 14 is accommodated in the avoidance groove 133, so that rotation of the rotating member 14 is not subjected to interference.

In this implementation, a length direction of the second limiting structure 1312 is perpendicular to a length direction of the fifth limiting structure 1322. A size of an opening of the accommodating groove is reduced by arranging the second limiting structure 1312 and the fifth limiting structure 1322 which are close to each other. In addition, the fourth limiting structure 1313 extends toward the rotating groove 134. When a side of the rotating member 14 is accommodated in the avoidance groove 133, the third limiting structure 1321 and the fourth limiting structure 1313 vertically limit the rotating member 14 after rotation; and the fifth limiting structure 1322 horizontally limits the rotating member 14.

The rotating member 14 includes a first rotating portion 141 arranged in an arc shape; a second rotating portion 142 extends from one end of the first rotating portion 141 to the other end of the first rotating portion 141; the first rotating portion 141 and the second rotating portion 142 form a movable groove 143; the third limiting structure 1321 and the fifth limiting structure 1322 are arranged in the movable groove 143, and the movable groove 143 rotates relative to the third limiting structure 1321 and the fifth limiting structure 1322; a side of the second rotating portion 142 close to the movable groove 143 is provided with a rotating shaft 144; the rotating shaft 144 extends into the rotating groove 134; and the rotating shaft 144 is movably arranged in the rotating groove 134. The rotating member 14 is movably arranged in the rotating groove 134 through the rotating shaft 144, and when the rotating member 14 rotates, the movable groove 143 rotates relative to the third limiting structure 1321 and the fifth limiting structure 1322. In this way, a matching effect between the fixing member 13 and the rotating member 14 is good.

In this implementation, a horizontal height of the second limiting structure 1312 is greater than that of the bottom of the rotating groove 134. In this way, the rotating groove 134 can better accommodate the rotating shaft 144, and a matching effect between the second rotating portion 142 and the second limiting structure 1312 is good.

The second limiting structure 1312 is configured to limit a rotation angle of the rotating member 14. When the rotating member 14 rotates, the second rotating portion 142 rotates relative to the rotating groove 134, and the second rotating portion 142 is away from the fifth limiting structure 1322 and approaches the second limiting structure 1312. An end of the first rotating portion 141 close to the second rotating portion 142 approaches the avoidance groove 133; and the avoidance groove 133 is provided to avoid the rotating member 14, which increases a moving amplitude of the rotating member 14 in the accommodating groove. When the second rotating portion 142 is in contact with the second limiting structure 1312, an end of the first rotating portion 141 close to the second rotating portion 142 is accommodated in the avoidance groove 133. The second limiting structure 1312 limits the second rotating portion 142, then the rotating member 14 cannot continue to be overturned upward, and an unfolding amplitude of the rotating support 12 is maximized.

The third limiting structure 1321 and the fifth limiting structure 1322 are configured to vertically limit the first rotating portion 141 before rotation, and the fifth limiting structure 1322 is configured to horizontally limit the second rotating portion 142 before rotation; the third limiting structure 1321 and the fourth limiting structure 1313 are configured to vertically limit the first rotating portion 141 after rotation, and the fifth limiting structure 1322 is configured to horizontally limit the second rotating portion 142 after rotation.

In this implementation, the avoidance groove 133, the rotating groove 134, the movable groove 143, the second limiting portion 132 and the rotating member 14 are arranged in an arc shape. In this way, a rotation effect is good.

A direction in which the rotating groove 134 is recessed is perpendicular to a direction in which the avoidance groove 133 is recessed. The rotating groove 134 and the avoidance groove 133 are each arranged on a side of the fixing member 13. A space of the accommodating groove is large, and the rotating groove 134 and the avoidance groove 133 do not interfere with each other. A moving range of the rotating member in the accommodating groove is large, and thus an opening and closing amplitude of the rotating support 12 relative to the fixed support 11 is large. The rotating member 14 rotates in the rotating groove 134. The avoidance groove 133 is configured to accommodate the rotating member 14; when the rotating member 14 rotates in the accommodating groove, the rotating member 14 gradually approaches the avoidance groove 133 until the rotating member 14 is accommodated in the avoidance groove 133, so that rotation of the rotating member 14 is not subjected to interference. In addition, because the avoidance groove 133 is formed by recessing the first limiting portion 131, when a side of the rotating member 14 is accommodated in the avoidance groove 133, the third limiting structure and the fourth limiting structure vertically limit the rotating member after rotation, and the first limiting structure and the fifth limiting structure horizontally limit the rotating member. In addition, the first rotating portion and the second rotating portion cover the third limiting structure and the fifth limiting structure. Through matching between the fixing member and the rotating member, the rotating member 14 cannot be separated from the fixing member 13, so that the rotating member 14 is stably arranged on the fixing member 13, and the rotating member 14 can reliably rotate on the fixing member 13.

The fixed support 11 includes a first plate body 111 and a second plate body 112; one side of the first plate body 111 is connected to the second plate body 112, and the other side of the first plate body 111 is connected to the first limiting structure 1311; the rotating support 12 includes a third plate body 121 and a rotating support member 122; one side of the third plate body 121 is connected to a first rotating portion 141, and the other side of the third plate body 121 is connected to the rotating support member 122; the rotating support member 122 is positioned below the second plate body 112 and the third plate body 121; a side of the rotating support member 122 close to the second plate body 112 is flush with the second plate body 112; the first plate body 111, the second plate body 112, the third plate body 121 and the rotating support member 122 form a power supply installation space 5; and the power supply installation space 5 is used for a power supply 3.

The second plate body 112 extends toward the rotating support 12 to form an elastic clamping member 113; the rotating support member 122 extends toward the second plate body 112 to form a clamping portion 124 and a lap joint portion 123; the clamping portion 124 is clamped on the elastic clamping member 113; and the lap joint portion 123 abuts against the second plate body 112. The lap joint portion abuts against the second plate body to implement connection between the rotating support member and the second plate body. When the rotating support 12 is folded, the elastic clamping member 113 clamps the clamping portion 124; the rotating support 12 is stably connected to the fixed support 11; and in a natural state, the elastic clamping member limits the clamping portion, so that the rotating support and the fixed support are not separated from each other. In addition, the elastic clamping member has elasticity. When the rotating support 12 is driven to be unfolded, it is convenient to separate the clamping portion 124 from the elastic clamping member 113.

A contact structure 7 is arranged at a bottom end of the rotating support member 122 away from the rotating member 14. The contact structure 7 is arranged to provide a point of strength. The contact structure 7 may be a recessed groove or a protruding portion. In this embodiment, the contact structure 7 is a groove.

A user may be in contact with the contact structure 7 through a tool, or may directly hold the rotating support 12 through the contact structure 7. Through action on the contact structure 7, it is convenient to unfold or fold the rotating support 12. In addition, the contact structure 7 is arranged away from the rotating member 14, and an arm of force between the contact structure 7 and the rotating member 14 is long, so that the rotating support 12 can be unfolded or folded easily.

A light-emitting assembly 2 is arranged in the rotating support member 122. The rotating support member 122 includes a fourth plate body 1221, a fifth plate body 1222, and a sixth plate body 1223. The fifth plate body 1222 is arranged close to the second plate body 112 and flush with the second plate body 112, and the lap joint portion 123 is formed by extending from the fifth plate body 1222 to the second plate body 112. The fourth plate body 1221 is inclined between the fifth plate body 1222 and the sixth plate body 1223. The fourth plate body 1221 connects the fifth plate body 1222 to the sixth plate body 1223. The clamping portion is formed by extending from the fourth plate body 1221 to the elastic clamping member 113. The sixth plate body 1223 is arranged on a side of the fifth plate body 1222 close to the third plate body 121. The sixth plate body 1223 is located below the third plate body 121. The contact structure 7 is arranged on the sixth plate body 1223.

The rotating support member 122 further includes a seventh plate body 1224. The seventh plate body 1224 is located below the fourth plate body 1221 and connected to the third plate body 121. The fourth plate body 1221, the fifth plate body 1222, the sixth plate body 1223 and the seventh plate body 1224 form a light source installation space 6. The light-emitting assembly 2 is installed in the light source installation space 6. A first accommodating area 125 is formed in the fifth plate body 1222. The seventh plate body 1224 is provided with a first mounting groove 1225, and the sixth plate body 1223 is provided with a second mounting groove 1226. The first mounting groove 1225 and the second mounting groove 1226 are opposite to each other and form a fourth accommodating area (not shown in the figure). The first accommodating area 125 is located on one side of the rotating support member 122, and the fourth accommodating area is located on the other side of the rotating support member 122.

Two sides of the first accommodating area 125 are each provided with a third mounting groove 1227. The two third mounting grooves 1227 are symmetrically arranged with respect to the first accommodating area 125. A side of the seventh plate body 1224 close to the fifth plate body 1222 is provided with a fourth mounting groove 1228. The fourth mounting groove 1228 is located above the third mounting groove 1227. One of the third mounting grooves 1227 and the fourth mounting groove form an inclined second accommodating area (not shown in the figure). A side of the sixth plate body 1223 away from the fifth plate body 1222 is provided with a fifth mounting groove 1229. The fifth mounting groove is located below the third mounting groove 1227. The other third mounting groove 1227 and the fifth mounting groove 1229 form an inclined third accommodating area (not shown in the figure). The second accommodating area and the third accommodating area are located between the first accommodating area 125 and the fourth accommodating area.

The light-emitting assembly 2 includes an LED light source 21, a first light guide plate 22, a second light guide plate 23, and a diffusion plate 24. The LED light source 21 is arranged in the first accommodating area 125. The first light guide plate 22 is arranged in the second accommodating area. The second light guide plate 23 is arranged in the third accommodating area. The diffusion plate 24 is arranged in the fourth accommodating area. Through the arrangement of the second accommodating area and the third accommodating area which are inclined, the first light guide plate 22 in the second accommodating area and the second light guide plate 23 in the third accommodating area are also inclined. In addition, the second accommodating area and the third accommodating area are inclined outward, and light emitted by the LED light source 21 is dispersed through the first light guide plate 22 and the second light guide plate 23, and then emitted from the diffusion plate 24, thereby enhancing illumination brightness of the lamp body 1.

A left end and a right end of the fixed support 11 are each provided with a first cover plate 15; the first cover plate 15 extends toward the fixed support 11 to form a first insertion portion 151; the first insertion portion 151 is arranged on one side of the first cover plate 15, and the first insertion portion 151 extends into the power supply installation space 5; and the first insertion portion 151 is configured to fix the first cover plate 15. The first insertion portion 151 extends into the fixed support 11 to fix the first cover plate 15. In this way, on the one hand, connection between the first cover plate 15 and the fixed support 11 is stable, which can increase a supporting strength of the lamp body 1 support; and on the other hand, the first insertion portion 151 extends into the fixed support 11 to provide pre-position for installation of the first cover plate 15.

The first insertion portion 151 includes a first support plate 1511 and a second support plate 1512. The first support plate 1511 is arranged at an end of the first cover plate 15, and the second support plate 1512 is arranged on one side of the first cover plate 15. The first support plate 1511 is configured to be in contact with the first plate body 111. The second support plate 1512 is configured to be in contact with the second plate body 112. The first plate body 111 is provided with a first mounting hole 1111, and the first support plate 1511 is provided with a first threaded hole 1513. The second plate body 112 is provided with a second mounting hole 1121, and the second support plate 1512 is provided with a second threaded hole 1514. A bolt passes through the first mounting hole 1111 and is in threaded connection with the first threaded hole 1513, and a bolt passes through the second mounting hole 1121 and is in threaded connection with the second threaded hole 1514, so that the first cover plate 15 is installed on the fixed support 11.

The first cover plate 15 further extends toward the fixed support 11 to form a first limiting member 152 and a second limiting member 153; the first limiting member 152 is arranged on the other side of the first cover plate 15; the second limiting member 153 is located between the first insertion portion 151 and the first limiting member 152 and arranged at an end of the first cover plate 15 away from the second support plate 1512; the first limiting member and the second limiting member extend into the power supply installation space 5; the first limiting member 152 interacts with the third plate body 121; the second limiting member 153 interacts with the fourth plate body 1221; the first limiting member 152 and the second limiting member 153 limit the rotating support 12; and when the rotating support 12 is in contact with the first limiting portion and the second limiting portion 132, folding of the rotating support 12 is implemented.

In this embodiment, a cross-sectional area of the first support plate 1511 and a cross-sectional area of the second support plate 1512 gradually decrease in a direction of the first cover plate 15 approaching the fixed support 11.

A left end and a right end of the rotating support 12 are each provided with a second cover plate 16; the second cover plate 16 extends toward the rotating support 12 to form a second insertion portion 161, a third insertion portion 162, and a fourth insertion portion 163. The second insertion portion 161, the third insertion portion 162 and the fourth insertion portion 163 extend into the light source installation space 6. The second insertion portion 161 is arranged at one end of the second cover plate 16, and the fourth insertion portion 163 is arranged at the other end of the second cover plate 16. The third insertion portion 162 is located between the second insertion portion 161 and the fourth insertion portion 163. The second insertion portion 161 is configured to be in contact with the fourth plate body 1221; the fourth plate body 1221 is provided with a third mounting hole 12211, the second insertion portion 161 is provided with a third threaded hole 1611, and an end of the second cover plate 16 away from the second insertion portion 161 is provided with a fourth mounting hole 164. The sixth plate body 1223 is provided with a fourth threaded hole 12231, a bolt passes through the third mounting hole 12211 and is in threaded connection with the third threaded hole 1611, and a bolt passes through the fourth mounting hole 164 and is in threaded connection with the fourth threaded hole 12231, so that the second cover plate 16 is installed on the rotating support 12.

A first insertion groove 165 is formed between the second insertion portion 161 and the third insertion portion 162. The first insertion groove 165 communicates with the second accommodating area. An end portion of the first light guide plate 22 is arranged in the first insertion groove 165. A second insertion groove 191 is formed between the fourth insertion portion 163 and the third insertion portion 162. The second insertion groove 191 communicates with the third accommodating area. An end portion of the second light guide plate 23 is arranged in the second insertion groove 191. This further improves stability of the first light guide plate 22 and the second light guide plate 23.

The third plate body 121 is provided with a control opening 1211, and a control end of the power supply 3 penetrates through the control opening 1211. The power supply 3 is provided to supply power to the LED light source 21, and the control end of the power supply 3 turns on or off the LED light source. The back of the fourth plate body 1221 is provided with a mounting hole 17; and through the mounting hole 17, the lamp body can be hung on a wall or a ceiling for use.

Adjacent lamp bodies 1 are detachably connected to each other by connectors 4. One end of each lamp body 1 is provided with a first interface 18, and the other end of the lamp body 1 is provided with a second interface 19. The first interface 18 is arranged on one first cover plate 15, and the second interface 19 is arranged on another first cover plate 15. First interfaces 18 and second interfaces 19 of adjacent lamp bodies 1 are detachably connected to each other by connectors 4; one end of each of the connectors 4 is provided with a first connecting portion 41 matching the first interface 18; and the other end of the connector 4 is provided with a second connecting portion 42 matching the second interface 19. Two or more lamp bodies 1 are connected by connectors 4 for use. When a lighting area needs to be enlarged, one lamp body 1 only needs to be electrically connected to another lamp body 1 by a connector 4, and thus a plurality of lamp bodies 1 can be installed for use. The number of lamp bodies 1 can be set according to a use scenario. The arrangements are suitable for a wide range of use scenarios.

A first insertion groove 181 is formed in the first interface 18; and a second insertion groove 191 is formed in the second interface 19. The first connecting portion 41 extends into the first insertion groove 181, and the second connecting portion 42 extends into the second insertion groove 191, so that the connector 4 connects the adjacent lamp bodies 1. A step portion 43 is formed on a surface of the connector 4. When the second connecting portion 42 extends into the second insertion groove 191, the step portion 43 abuts against a surface of the second interface 19. The first interface 18 is electrically connected to the first connecting portion 41, and the second interface 19 is electrically connected to the second connecting portion 42.

In this implementation, the connector 4 is a rigid connector; the first connecting portion 41 and the second connecting portion 42 are integrally arranged; adjacent lamp bodies 1 are closely attached to each other; and the first connecting portion 41 and the second connecting portion 42 are hidden between adjacent lamp bodies 1. Adjacent lamp bodies 1 are closely attached to each other. When lamp bodies 1 are connected to each other, the lamp bodies 1 are closely attached to each other to shield the rigid connector, so that the rigid connector is not exposed, and the appearance is attractive. In addition, when lamp bodies 1 are connected to each other, the rigid connector 4 provides a supporting force for two adjacent lamp bodies 1, so that the rigid connector supports the joint of the lamp bodies 1. This can ensure stable use.

In another implementation, the connector 4 is a flexible connector; the connector further includes a flexible connecting member 44; the first connecting portion 41 and the second connecting portion 42 are split, and the flexible connecting member 44 is connected between the first connecting portion 41 and the second connecting portion 42. Through the arrangement of the flexible connecting member, the first connecting portion 41 can move relative to the second connecting portion 42. In this way, during use, due to the limitation of an installation scenario, the adjacent lamp bodies 1 need to be installed separately. When the adjacent lamp bodies 1 are not on the same straight line, the flexible connector 4 is used to facilitate connection between the adjacent lamp bodies 1.

A method for installing a lamp body includes the following steps.

Step (1): A light-emitting assembly and a second cover plate are installed on a rotating support.

Step (2): A fixed support is fixed and a power supply is installed.

Step (3): A rotating member is slidably arranged in a fixing member, the rotating support is unfolded, and then a first cover plate is installed.

That the rotating support is unfolded is specifically as follows: A rotating shaft rotates in a rotating groove, a second rotating portion gradually approaches a second limiting structure, an end of the rotating member gradually approaches an avoidance groove, and a first rotating portion covering a second limiting portion approaches a fifth limiting structure; a clamping portion is away from an elastic clamping member; a lap joint portion is away from a second plate body; when a second rotating portion is in contact with the second limiting structure, the second limiting structure limits the second rotating portion; the rotating support is in transition from a vertical state to a horizontal state; unfolding of the rotating support is completed; a fourth limiting structure, the second limiting structure and the fifth limiting structure limit the rotating member in a longitudinal direction; and a first limiting structure and the fifth limiting structure limit the rotating member in a transverse direction.

Step (4): The power supply is electrically connected to the light-emitting assembly.

Step (5): The rotating support is folded.

That the rotating support is folded is specifically as follows: The rotating shaft rotates in the rotating groove, and the second rotating portion is separated from the second limiting structure and gradually approaches the second limiting portion; the rotating member accommodated in the avoidance groove is gradually away from the avoidance groove; the first rotating portion covering the second limiting portion approaches the second limiting structure; the clamping portion approaches the elastic clamping member; the lap joint portion approaches the second plate body; when the second rotating portion is in contact with the fifth limiting structure, the fifth limiting structure limits the second rotating portion; the clamping portion is clamped on the elastic clamping member; the lap joint portion abuts against the second plate body; the first limiting member limits a third plate body, and a second limiting member limits a rotating support member; the rotating support is in transition from the horizontal state to the vertical state, folding of the rotating support is completed, and the fifth limiting structure and the third limiting structure limit the rotating member in the longitudinal direction; and the second limiting structure and the fifth limiting structure limit the rotating member in the transverse direction.

In the forgoing method, the light-emitting assembly and the second cover plate are installed first to facilitate matching between the rotating support and the fixed support; then the rotating support is installed on the fixed support; in addition, the rotating support is unfolded; this makes a space between the fixed support and the rotating support large, facilitates electric connection of the power supply to the light-emitting assembly, and is convenient to operate; then the first cover plate is installed to limit the rotating support, so that the rotating support cannot be separated from the fixed support; and after the power supply is connected to the light-emitting assembly, the rotating support is folded. When the rotating support is unfolded, and the rotating member rotates in the accommodating groove, the rotating member gradually approaches the avoidance groove until the rotating member is accommodated in the avoidance groove. This protects movement of the rotating member from interference and avoids the rotating member, a moving amplitude of the rotating member in the accommodating groove is large, and thus an unfolding amplitude of the rotating support is large. When the second rotating portion is in contact with the second limiting structure, the second limiting structure limits a rotation angle of the rotating member, so that a maximum rotation angle of the rotating member is 90°. The rotating member is prevented from being separated from the fixing member. In addition, the fourth limiting structure, the second limiting structure and the fifth limiting structure limit the rotating member in the longitudinal direction, and the first limiting structure and the fifth limiting structure limit the rotating member in the transverse direction, so that the rotating member reliably rotates on the fixing member.

When the rotating support is folded, and the rotating member rotates in the accommodating groove, the rotating member accommodated in the avoidance groove is separated from the avoidance groove and gradually away from the avoidance groove. In addition, the second limiting portion approaches the fifth limiting structure. When the second rotating portion is in contact with the fifth limiting structure, the fifth limiting structure limits the rotation angle of the rotating member, so that the rotating support can be attached to the fixed support, and the rotating support and the fixed support match well.

In the foregoing method, step (1) is specifically as follows: The second cover plate is installed on one side of the rotating support, then the LED light source is slidably arranged in a first accommodating area on the other side of the rotating support, a first light guide plate is slidably arranged in a second accommodating area, a second light guide plate is slidably arranged in a third accommodating area, a diffusion plate is slidably arranged in a fourth accommodating area, and then the second cover plate is installed on the other side of the rotating support.

The invention claimed is:

1. A reversible LED lamp, comprising a lamp body, wherein the lamp body comprises a fixed support and a rotating support, wherein the fixed support is connected to a fixing member, the rotating support is connected to a rotating member, and the rotating member is rotatably arranged on the fixing member; the fixed support is arranged on one side of the lamp body, and the rotating support is arranged on the other side of the lamp body; the fixing member comprises a first limiting member and a second limiting member, and the second limiting member is located on a side of the first limiting member; the first limiting member is recessed in a direction away from the second limiting member to form an avoidance groove, and the avoidance groove is configured to accommodate the rotating member; and the fixed support comprises a first plate body and a second plate body; one side of the first plate body is connected to the second plate body, and the other side of the first plate body is connected to the first limiting member; the rotating support comprises a third plate body and a rotating support member; one side of the third plate body is connected to a first rotating portion, and the other side of the third plate body is connected to the rotating support member; the rotating support member is positioned below the second plate body and the third plate body; a side of the rotating support member close to the second plate body is flush with the second plate body; the first plate body, the second plate body, the third plate body and the rotating support member form a power supply installation space; a light source installation space is formed in the rotating support member, and a light-emitting assembly is arranged in the light source installation space.

2. The reversible LED lamp according to claim 1, wherein the second plate body extends toward the rotating support to form an elastic clamping member; the rotating support member extends toward the second plate body to form a clamping portion and a lap joint portion; the clamping portion is clamped on the elastic clamping member; the lap joint portion abuts against the second plate body; and a contact structure is arranged at a bottom end of the rotating support member away from the rotating member.

3. The reversible LED lamp according to claim 1, wherein the first limiting portion comprises a first limiting structure, a second limiting structure, and a fourth limiting structure; the second limiting portion comprises a third limiting structure and a fifth limiting structure; the first limiting structure is connected to one side of the second limiting structure, and the other side of the second limiting structure is connected to one end of the third limiting structure;

the avoidance groove is formed in the first limiting structure by recessing in a direction away from the second limiting portion; the second limiting structure is recessed to form a rotating groove, and the rotating groove is formed by recessing in a direction perpendicular to the recessing direction of the avoidance groove; and the fourth limiting structure is formed by extending from the top of the first limiting structure in a direction close to the rotating groove, and the avoidance groove is connected to the second limiting structure and the fourth limiting structure; the fifth limiting structure is formed by extending from the other end of the third limiting structure in a direction close to the fourth limiting structure; the rotating groove is connected to the fourth limiting structure and the fifth limiting structure; an accommodating groove is formed by the avoidance groove and the rotating groove; and the avoidance groove, the rotating groove, the second limiting portion and the rotating member are arranged in an arc shape.

4. The reversible LED lamp according to claim 3, wherein the rotating member comprises a first rotating portion arranged in an arc shape; a second rotating portion extends from one end of the first rotating portion to the other end of the first rotating portion; the first rotating portion and the second rotating portion form an arc-shaped movable groove; the first rotating portion and the second rotating portion cover the third limiting structure and the fifth limiting structure; a side of the second rotating portion close to the movable groove is provided with a rotating shaft; the rotating shaft extends into the rotating groove; the rotating shaft is movably arranged in the rotating groove; the second limiting structure is configured to limit a rotation angle of the rotating member; the third limiting structure and the fifth limiting structure are configured to vertically limit the first rotating portion before rotation, and the fifth limiting structure is configured to horizontally limit the second rotating portion before rotation; the third limiting structure and the fourth limiting structure are configured to vertically limit the first rotating portion after rotation, and the fifth limiting structure is configured to horizontally limit the second rotating portion after rotation.

5. The reversible LED lamp according to claim 1, wherein a left end and a right end of the fixed support are each provided with a first cover plate; the first cover plate extends toward the fixed support to form a first insertion portion; the first insertion portion is arranged on one side of the first cover plate, and the first insertion portion extends into the power supply installation space; and the first insertion portion is configured to fix the first cover plate.

6. The reversible LED lamp according to claim 5, wherein the first cover plate extends toward the fixed support to form a first limiting member and a second limiting member; the first limiting member is arranged on the other side of the first cover plate; the second limiting member is located between the first insertion portion and the first limiting member and arranged at an end of the first cover plate; the first limiting member and the second limiting member extend into the power supply installation space; the first limiting member interacts with the third plate body; the second limiting member interacts with a fourth plate body; and the first limiting member and the second limiting member limit the rotating support.

7. The reversible LED lamp according to claim 1, wherein the light source installation space comprises a first accommodating area, a second accommodating area, a third accommodating area, and a fourth accommodating area; the first accommodating area is located on one side of the rotating support member, and the fourth accommodating area is located on the other side of the rotating support member; the second accommodating area and the third accommodating area are located between the first accommodating area and the fourth accommodating area; the first accommodating area is located between the second accommodating area and the third accommodating area; in a direction from the first accommodating area to the fourth accommodating area, the second accommodating area and the third accommodating area are separately inclined outward; the light-emitting assembly comprises an LED light source, a first light guide plate, a second light guide plate, and a diffusion plate; the LED light source is arranged in the first accommodating area; the first light guide plate is arranged in the second accommodating area; the second light guide plate is arranged in the third accommodating area; and the diffusion plate is arranged in the fourth accommodating area.

8. The reversible LED lamp according to claim 7, wherein a left end and a right end of the rotating support are each provided with a second cover plate; the second cover plate extends toward the rotating support to form a second insertion portion and a fourth insertion portion; the second insertion portion is arranged at one end of the second cover plate, and the fourth insertion portion is arranged at the other end of the second cover plate; the second insertion portion and the fourth insertion portion extend into the light source installation space; and the second insertion portion and the fourth insertion portion are configured to fix the second cover plate.

9. The reversible LED lamp according to claim 8, wherein the second cover plate extends toward the rotating support to form a third insertion portion; the third insertion portion is located between the second insertion portion and the fourth insertion portion; a first insertion groove is formed between the second insertion portion and the third insertion portion; the first insertion groove communicates with the second accommodating area; a second insertion groove is formed between the fourth insertion portion and the third insertion portion; and the second insertion groove communicates with the third accommodating area.

10. The reversible LED lamp according to claim 1, wherein adjacent lamp bodies are detachably connected to each other by connectors; one end of each lamp body is provided with a first interface; the other end of the lamp body is provided with a second interface; first interfaces and second interfaces of the adjacent lamp bodies are detachably connected to each other by connectors; one end of each of the connectors is provided with a first connecting portion matching the first interface; and the other end of the connector is provided with a second connecting portion matching the second interface.

* * * * *